US005488262A

United States Patent [19]

Takamura

[11] Patent Number: 5,488,262

[45] Date of Patent: Jan. 30, 1996

[54] SPARK ELECTRODE HAVING LOW THERMAL STRESS

[75] Inventor: Kozo Takamura, Nagoya, Japan

[73] Assignee: Nippondenso Co., Ltd., Kariya, Japan

[21] Appl. No.: 987,951

[22] Filed: Dec. 11, 1992

[30] Foreign Application Priority Data

Dec. 13, 1991 [JP] Japan ..... 3-330630

[51] Int. Cl.[6] ..... H01T 13/20

[52] U.S. Cl. ..... 313/141; 313/142

[58] Field of Search ..... 313/141, 142; 123/169 EL

[56] References Cited

U.S. PATENT DOCUMENTS

| | | | |
|---|---|---|---|
| 4,122,366 | 10/1978 | Von Stutterheim et al. | 313/141 |
| 4,540,910 | 9/1985 | Kondo et al. | 313/141 X |
| 4,670,684 | 6/1987 | Kagawa et al. | 313/141 |

FOREIGN PATENT DOCUMENTS

| | | | |
|---|---|---|---|
| 3811395 | 11/1988 | Germany | 313/141 |
| 57-130385 | 8/1982 | Japan . | |
| 60-262374 | 12/1985 | Japan . | |
| 61-31945 | 7/1986 | Japan . | |
| 0230283 | 10/1986 | Japan | 313/141 |

*Primary Examiner*—Sandra L. O'Shea
*Assistant Examiner*—Vip Patel
*Attorney, Agent, or Firm*—Cushman, Darby & Cushman

[57] ABSTRACT

A spark discharge tip, such as for a spark plug for an internal combustion engine in which the life of the tip is prolonged. A composite material is formed by bonding a material for a discharge layer, mainly composed of platinum, to a material for a thermal stress relieving layer, which is an alloy mainly composed of platinum, and having a coefficient of thermal expansion between that of the electrode and that of the discharge layer. A composite tip is formed by stamping the composite material into a columnar shape from the discharge layer side so that the periphery of the interface between the discharge layer and stress relieving layer is covered by the discharge layer. The composite tip is then resistance welded to the electrode.

23 Claims, 5 Drawing Sheets

SPARK ELECTRODE HAVING LOW THERMAL STRESS

BACKGROUND OF THE INVENTION

1. Field of the Invention

The present invention relates to an improvement of a noble metal tip provided at a spark discharge gap. Such a tip may be used with a spark plug for an internal combustion engine. The present invention also relates to a method of manufacturing the same which improves heat resistance and durability.

2. Description of the Prior Art

A spark plug for an internal combustion engine has a center electrode and an earth electrode which face each other and produce a spark discharge when a high voltage is applied between the electrodes. Discharge tips composed of noble metals are mounted respectively on sections of the pair of electrode members facing each other to define a gap for producing spark discharge between the tips.

Conventionally, in order to prolong the life of such a spark plug, the tip structure has included a thermal stress relieving layer joined between a layer made of a discharge member and each electrode as disclosed, for example, in Japanese Patent Laid-open No. 60-262374.

However, the life of the product cannot be effectively prolonged simply by including the stress relieving layer if it is joined to the electrode by resistance welding.

When such a composite tip is resistance-welded to the electrode, welding current generates heat at the interface between the discharge layer and the stress relieving layer and thermal deformation is caused due to the heat and welding pressure. This deformation appears as an expansion in the radial direction of the tip, particularly at the interface between the discharge layer and stress relieving layer.

FIG. 5 shows a sectional structure of an earth electrode 14 of a spark plug having a composite tip 13 including a discharge layer 11 and a thermal stress relieving layer 12. In the Figure, composite tip 13, after it has been joined to earth electrode 14 by resistance welding, becomes generally trapezoidal in sectional shape due to the expansion of stress relieving layer 12. Alternatively, earth electrode 14 contacts the periphery of the interface between discharge layer 11 and stress relieving layer 12, due to a remarkable expansion of stress relieving layer 12. If the composite tip has a tapered sectional shape even before welding, as shown in the aforementioned Laid-open document, the deformation becomes even more pronounced after welding.

Further, even if the sectional tapered shape of the composite member is turned up side down as compared to the above example, the difference of size between the discharge layer and stress relieving layer is about 0.05 mm, which hardly compensates for the thermal deformation in the radial direction during resistance welding of the tip.

When a tip with the trapezoidal shape is used, discharge layer 11 becomes thin as a result of spark consumption over a long period of time and spark discharge is then generated from the periphery of stress relieving layer 12. Therefore, stress relieving layer 12 is consumed. Also, stress relieving layer 12 is directly exposed to high temperatures and the oxidizing atmosphere of the combustion chamber of the internal combustion engine, thereby advancing oxidation and corrosion thereof. Spark consumption, oxidation and corrosion of stress relieving layer 12 damage its thermal stress relieving function and causes discharge layer 11 to fail, shortening the life of the spark plug.

Accordingly, it is an object of the present invention to overcome the aforementioned problems by providing a spark electrode tip such as for a spark plug for an internal combustion engine and a method of manufacturing the same having a stress relieving layer joined to a discharge layer and also resistance welded to an electrode, yet which prolongs the life of the tip and is reliable.

SUMMARY OF THE INVENTION

In order to achieve the aforementioned goal, according to the present invention, the tip includes a composite structure having a discharge layer and thermal stress relieving layer, interposed between the discharge layer and the electrode base to relieve thermal stress generated at the interface of the junction with the discharge layer. The discharge layer is composed of a material having an excellent resistance to spark consumption. The periphery of the stress relieving layer including the periphery of the interface between the discharge layer and the stress relieving layer is covered by the discharge member.

The discharge layer may be made of a material including platinum. The stress relieving layer may be made of material including platinum and having a hardness equal to or more than that of the discharge layer.

The composite tip is manufactured by stamping a plate, in which the material for the discharge layer and stress relieving layer are laminated together, from the direction of the discharge layer in a shape corresponding to a discharge tip. Then the stress relieving layer is resistance welded to an electrode member.

The composite tip described above obtains the stress reducing advantages of a stress relieving layer. At the same time, the periphery of the stress relieving layer, including the interface between the discharge layer and stress relieving layer, is covered by the discharge layer, so that the stress relieving layer is not exposed. Accordingly, the goal for prolonging the life of the tip may be achieved and reliability is improved.

BRIEF DESCRIPTION OF THE DRAWINGS

The manner in which the foregoing and other objects of this invention are accomplished will be apparent from the accompanying specification and claims considered together with the drawings wherein:

DETAILED DESCRIPTION OF THE PREFERRED EMBODIMENT

Figure 1:
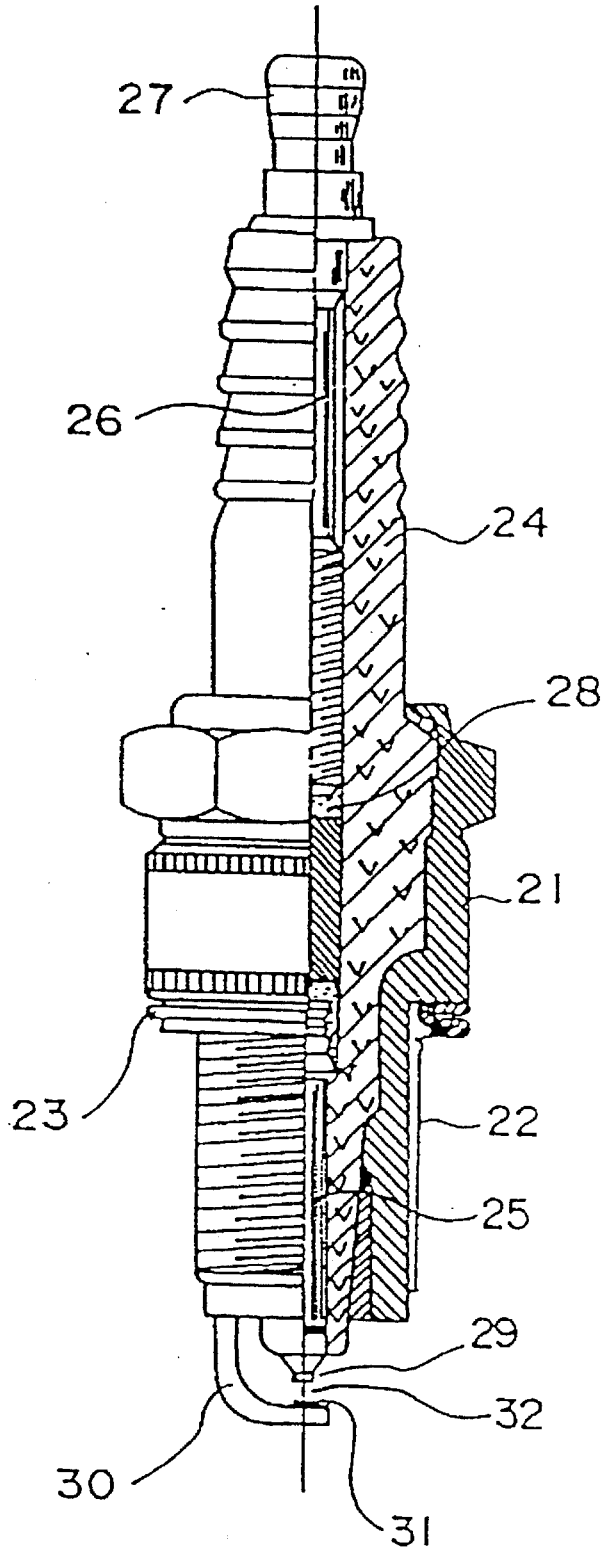
FIG. 1 is a section view illustrating a structure of a spark plug for an internal combustion engine according to one embodiment of the present invention.

Referring now to the drawings, one embodiment of the present invention will be explained in detail.

FIG. 1 shows a sectional structure of a spark plug used for an internal combustion engine. A cylindrical housing 21 made of a metallic material has a thread groove 22 formed on an outer, lower peripheral section. Housing 21 is mounted to a cylinder head section (not shown) of the internal combustion engine by means of thread groove 22. An air tight seal is maintained by a gasket 23.

The lower end portion of a cylindrical insulator 24 is fitted coaxially in housing 21 and a center electrode 25 is inserted and fixed at the center hole section of insulator 24 in correspondence to the lower end portion of insulator 24. Electrode 25 is a column whose inner member is composed of copper and whose outer member is composed of Ni base alloy and whose tip portion is exposed out of the lower end of the insulator 24.

A center conductor 26 is inserted in the upper portion of the hollow section of insulator 24. An end of center conductor 26 extends above insulator 24 to provide terminal 27 through which an ignition voltage signal is supplied. A conductive glass sealing material 28 is interposed between center conductor 26 and center electrode 25. Sealing material 28 is heated to weld center conductor 26 and center electrode 25 to electrically connect them.

A first discharge electrode tip 29 is composed of a noble metal and is welded and mounted to the surface of center electrode 25.

An earth electrode 30, extending from and integral with housing 21 faces tip 29. A second tip 31 is welded and mounted on earth electrode 30 at a position facing tip 29 to form a gap 32 for generating a spark discharge.

Figure 2:
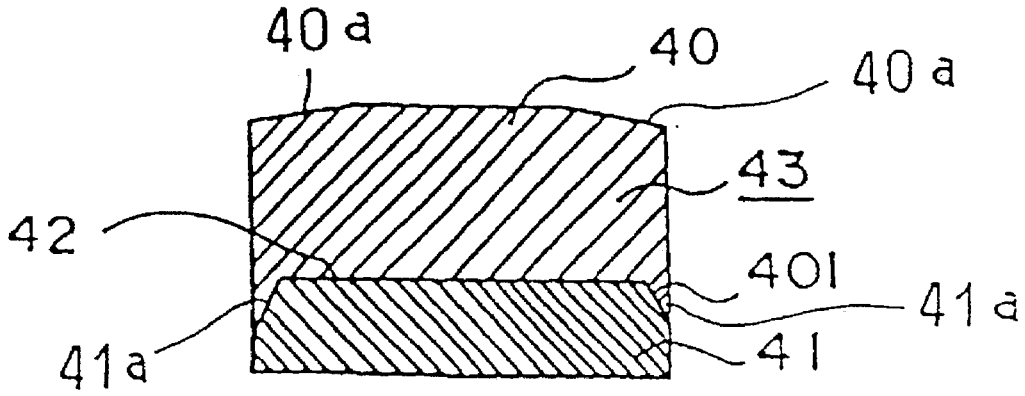
FIG. 2 is a section view illustrating a state of a tip to be joined to an earth electrode of the spark plug in FIG. 1 by welding.

FIG. 2 shows an initial sectional structure of second tip 31 before being welded on earth electrode 30. As shown in FIG. 2, tip 31 is a composite of a discharge layer 40 joined to a thermal stress relieving layer 41. Discharge layer 40 is composed of an alloy whose main component is platinum and has an excellent resistance to spark consumption. Stress relieving layer 41 is composed of an alloy whose main component is a noble metal such as platinum.

Stress relieving layer 41 is interposed between discharge layer 40 and earth electrode 30 in order to reduce thermal stress produced at the interface between discharge layer 40 and earth electrode 30. A coefficient of thermal expansion of stress relieving layer 41 is set so that its value is between the coefficients of thermal expansion of discharge layer 40 and the material of earth electrode 30.

Figure 3:
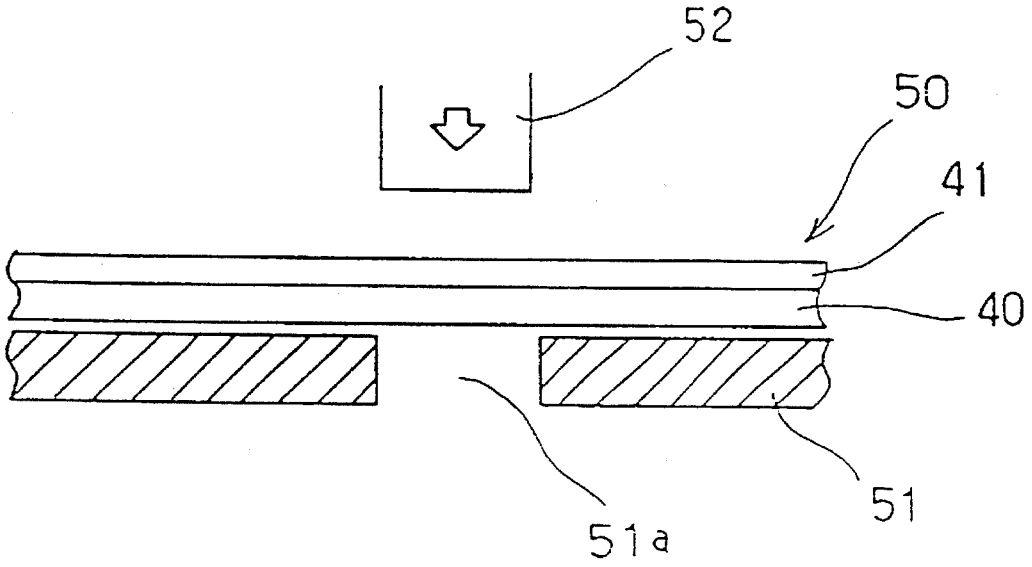
FIG. 3 is an explanatory drawing illustrating how a discharge layer and stress relieving layer are joined.

FIG. 3 is an explanatory drawing illustrating a method for forming discharge layer 40 and stress relieving layer 41. First, a plate 50, in which materials for discharge layer 40 and stress relieving layer 41 are laminated, is placed on a base plate 51 with the material of discharge layer 40 facing downward. Base plate 51 is provided with a round hole **51*a* having a desired tip diameter. Plate 50 is placed so that it covers hole 51*a*. Then a press 52 is driven down toward hole 51*a* of base plate 51 to obtain a round composite tip 43 having the desired diameter from plate material 50**.

Thus the composite material having a double layer structure in which the discharge layer 40 and thermal stress relieving layer member 41 are joined, is stamped in a columnar shape from the stress relieving layer 41 side. By stamping as described above, a shear drop **40*a* is created at the periphery section of the discharge layer 40. A shear drop 41*a* is also created at the periphery of stress relieving layer 41 due to the shear drop 40*a*. Then a portion 401 of the discharge layer fills shear drop 41*a* of stress relieving layer 41. As a result, a composite tip 43 is formed having a sectional shape covered by discharge layer portion 401**.

Figure 4:
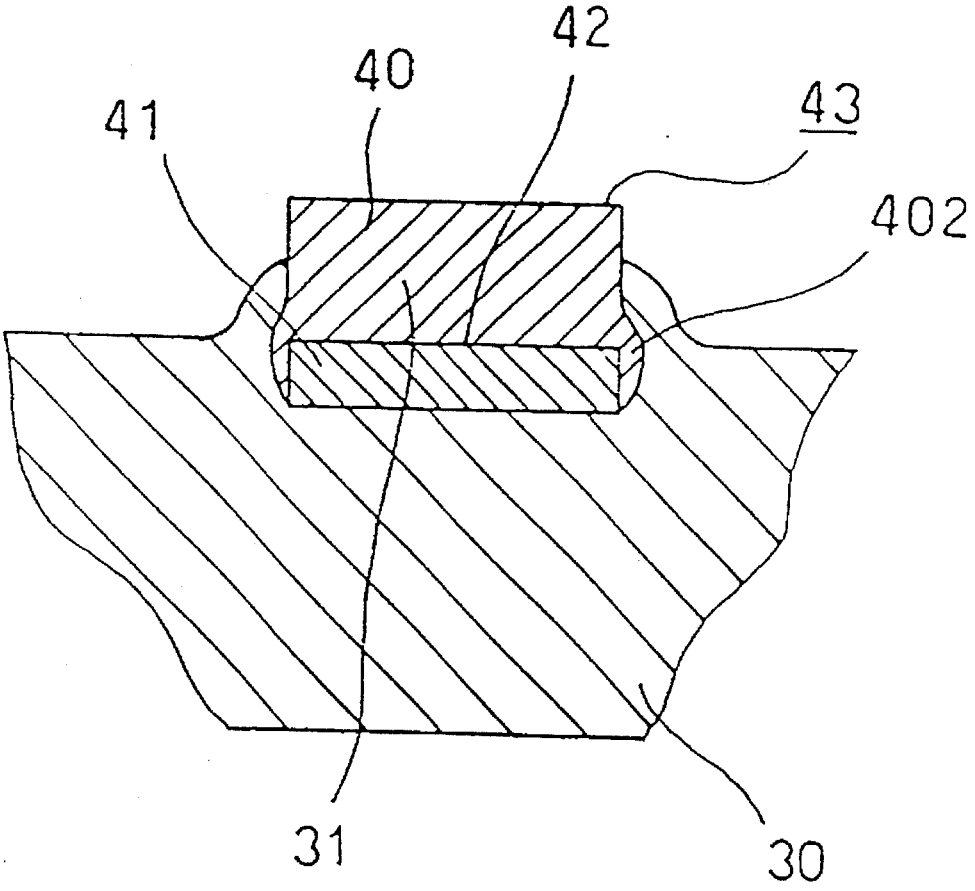
FIG. 4 is a section view illustrating the tip in FIG. 2 joined to the earth electrode
Figure 5:
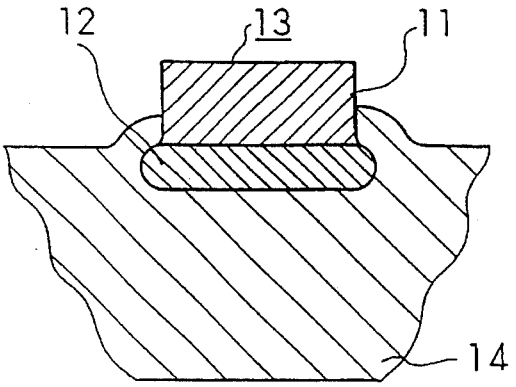
FIG. 5 (PRIOR ART)
FIG. 5 is a section view illustrating a tip junction section of a prior art example.

The stress relieving layer 41 side of composite tip 43 is resistance welded to earth electrode 30 as shown in FIG. 4. The material of discharge layer 40 is selected to be no harder than the material of stress relieving layer 41. Therefore, during welding, thermal deformation of discharge layer 40 is greater than that of stress relieving layer 41. Accordingly, a skirt section 402 is created in discharge layer 40 about the periphery of stress relieving layer 41. Thus, the periphery of stress relieving layer 41 is covered by skirt section 402.

Since the periphery of stress relieving layer 41 is covered by skirt section 402, stress relieving layer 41 remains protected after spark consumption of the base material of earth electrode 30 and is protected from high temperature oxidizing due to combustion near interface 42 of stress relieving layer 41 and discharge layer 40 when the spark plug is used for a long period of time. Accordingly, stress relieving layer 41 can reduce thermal stress caused by the difference in the coefficient of thermal expansion of discharge layer 40 and that of earth electrode 30 and the life of the spark plug may be achieved as targeted.

Although FIG. 4 illustrates skirt section 402 covering the entire periphery of stress relieving layer 41, the advantageous effects of the present invention can also be achieved if skirt 402 covers only a portion of the periphery of stress relieving layer 41. In fact, depending on the hardness of discharge layer 40 and stress relieving layer 41 and the pressure and temperature used in resistance welding, discharge layer 40 need not extend beyond the diameter of stress relieving layer 41. Portion 401 itself is sufficient to achieve the results of the present invention. In this case, discharge layer 40 and stress relieving layer 41 have the same diameter.

Next, sectional shapes of the discharge layer and relaxation layer after welding are studied when the kind of the alloy of the discharge layer and that of the stress relieving layer are altered. The following Table 1 shows the result.

TABLE 1

| No. Layer | Discharge (Weight %) | Stress Relieving Layer | Sectional Shape After Welding | Hardness Hv (after annealing) Discharge Layer | Hardness Hv (after annealing) Relaxation Layer |
|---|---|---|---|---|---|
| 1 | 90Pt—10Ir | 95Pt—5Ni | O | 120 | 120 |
| 2 | | 80Pt—20Ni | O | | 240 |
| 3 | | 95Pt—5Co | X | | 80 |
| 4 | | 90Pt—10Co | O | | 160 |
| 5 | | 95Pt—5Ag | X | | 80 |
| 6 | | 95Pt—5Au | X | | 100 |
| 7 | | 80Pt—20Au | O | | 135 |
| 8 | | 90Pt—10Rh | X | | 90 |
| 9 | | 90Pt—10Pd | X | | 60 |
| 10 | 80Pt—20Ir | 95Pt—5Ni | X | 220 | 120 |
| 11 | | 80Pt—20Ni | O | | 240 |
| 12 | | 90Pt—10Co | X | | 160 |
| 13 | | 80Pt—20Ag | O | | 210 |
| 14 | | 80Pt—20Au | X | | 135 |
| 15 | | 90Pt—10Rh | X | | 90 |
| 16 | | 80Pd—20Ni | X | | 190 |

Table 1 shows respective study results of the composite tips of each combination when discharge layer 40 is composed of "Pt—Ir" and stress relieving layer 41 is composed of various alloys including platinum. The composite tips were stamped into a columnar shape from the discharge layer 40 side with a diameter of 0.9 mm and a height of 0.6 mm. The thicknesses of discharge layer 40 and relaxation layer 41 were set, respectively, to 0.4 mm and 0.2 mm.

Then, the specimens were welded to electrodes with a force of 25 Kg. The resistance welding was performed with 10 cycles of resistance welding current in a range from 650 A to 800 A.

Hardnesses Hv of the discharge layers and the relaxation layers after annealing are listed at the right of Table 1. It can be seen that the elongation deformation of composite tip 43 caused by Joule heat generated on the surface of stress relieving layer 41 and earth electrode 30 and by the welding force during the resistance welding corresponds to the hardness of the materials. In Table 1, an "O" in the column labeled "Sectional Shape After Welding" indicates an acceptable shape and an "X" indicates an unacceptable shape. That is, to assure that composite tip 43 has the sectional shape shown in FIG. 2, the hardness of stress relieving layer 41 needs to be substantially equal to or more than that of discharge layer 40.

Although the above discussion relates to second tip 31 which was joined to earth electrode 30, the life of the spark plug may be prolonged and its reliability can be improved by structuring first tip 29, joined to the tip of center electrode 25, in the same way.

Figure 6:
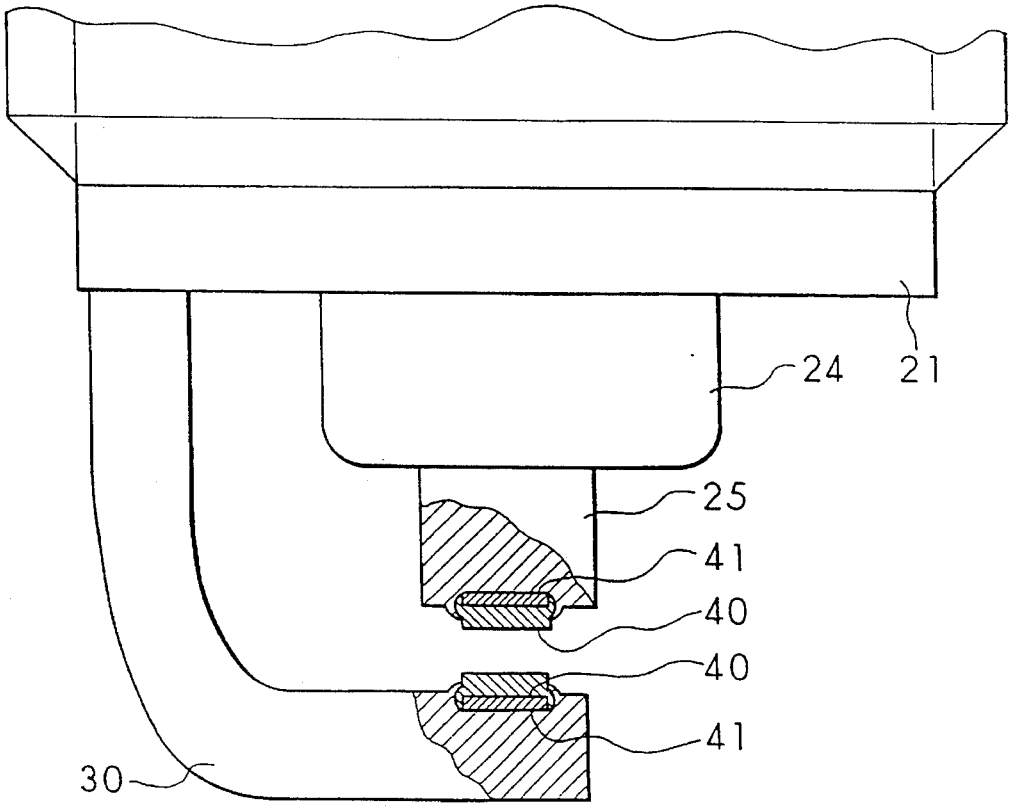
FIG. 6 is a cut-away view, partly in section showing the spark plug according to the present invention having first and second electrodes facing each other.

FIG. 6 is a spark plug having first and second electrodes facing each other. At least one of the electrodes includes a stress relieving layer 41 and a discharge layer 40 as described above.

As described above, according to the present invention, the relaxation layer may be protected for a long period of time, the life of the spark plug may be prolonged and the reliability thereof may be improved utilizing thermal deformation produced during resistance welding of the composite tip by structuring the tip so that the hardness of the stress relieving layer is equal to or more than that of the discharge layer. In this case, a more rigid junction shape may be obtained by stamping the composite material from the discharge layer side.

While the described embodiment represents the preferred form of the present invention, it is to be understood that modifications will occur to those skilled in the art without departing from the spirit of the invention. The scope of the invention is therefore to be determined solely by the appended claims.

What is claimed is:

1. A spark electrode comprising:

a base metal having at least a portion thereof proximate a spark gap;

a thermal stress relieving layer for reducing thermal stress welded to said base metal at said portion proximate said spark gap; and a corrosion resistant discharge layer bonded to a side of said thermal stress relieving layer opposite said base metal and including portions surrounding at least a portion of peripheral edges of said thermal stress relieving layer.

2. The spark electrode as in claim 1, wherein a hardness of said stress relieving layer is substantially equal to or more than that of said discharge electrode.

3. The spark electrode as in claim 1, wherein the coefficient of thermal expansion of said stress relieving layer is intermediate of that of said base and that of said discharge layer.

4. The spark electrode as in claim 1, wherein said discharge layer includes platinum.

5. The spark electrode as in claim 4, wherein said stress relieving layer includes an alloy of platinum.

6. The spark electrode as in claim 4, wherein said stress relieving layer includes an alloy of a primary material of said discharge layer.

7. The spark electrode as in claim 1, wherein:

said peripheral edges of said stress relieving layer comprises inclined peripheral surfaces contacting said discharge layer; and said discharge layer extends toward said stress relieving layer to contact said inclined surfaces.

8. The spark electrode as in claim 7, wherein a diameter of said stress relieving layer is the same as that of said discharge layer.

9. The spark electrode as in claim 1, wherein said discharge layer covers said peripheral edges of said stress relieving layer through the entire thickness of said stress relieving layer.

10. A spark plug, comprising:

first and second electrodes facing each other;

a corrosion resistant discharge layer provided on at least one of said first and second electrodes; and a thermal stress relieving layer disposed between said at least one of said electrodes and said discharge layer, said discharge layer surrounding at least a portion of peripheral edges of said thermal stress relieving layer.

11. The spark plug as claimed in claim 10, wherein said thermal stress relieving layer is provided to relieve thermal stress generated between said discharge layer and said at least one of said electrodes.

12. The spark plug as claimed in claim 10, wherein:

a surface of said stress relieving layer contacting said discharge layer has an inclined peripheral edge; and said discharge layer extends toward said stress relieving layer to contact said inclined edge.

13. The spark plug as claimed in claim 12, wherein a diameter of said stress relieving layer is the same as that of said discharge layer.

14. The spark plug as claimed in claim 10, wherein said discharge layer comprises platinum.

15. The spark plug as claimed in claim 10, wherein:

said peripheral edges of said stress relieving layer comprise inclined peripheral surfaces contacting said discharge layer; and said discharge layer extends toward said stress relieving layer to contact said inclined surfaces.

16. The spark plug as claimed in claim 10, wherein both of said first and second electrodes have said stress relieving layer and said discharge layer.

17. The spark plug as claimed in claim 10, wherein said stress relieving layer is an alloy of a primary material of said discharge layer.

18. The spark plug as in claim 10, wherein said discharge layer covers said peripheral edges of said stress relieving layer through the entire thickness of said stress relieving layer.

19. A spark plug for an internal combustion engine, comprising:

first and second electrodes facing each other; and a composite material provided on at least one of said first and second electrodes, said composite material including:

a discharge layer composed of a corrosion resistant material;

a thermal stress relieving layer provided to relax thermal stress generated at an interface with said discharge layer, said thermal stress relieving layer composed of material including platinum and having a hardness substantially equal to or more than a hardness of said discharge layer; and said discharge layer and said thermal stress relieving layer being joined so that said thermal stress relieving layer is interposed between said discharge layer and said electrode, and so that a periphery of said thermal stress relieving layer including a periphery of said interface between said discharge layer and said thermal stress relieving layer is covered by said discharge layer.

20. A spark plug as claimed in claim 19, wherein said composite material is provided on both said first and second electrodes.

21. A spark plug comprising:

first and second electrodes facing each other;

a thermal stress relieving layer disposed on at least one of said first and second electrodes and including peripheral edges inclined with respect to said at least one electrode; and a corrosion discharge layer disposed on said thermal stress relieving layer and covering at least a portion of said peripheral edges.

22. The spark plug according to claim 21, wherein said peripheral edges include side surfaces substantially perpendicular to said at least one electrode.

23. The spark plug according to claim 22, wherein said peripheral edges include an upper portion including peripheral surfaces inclined with respect to said side surfaces.

* * * * *